US005873762A

United States Patent [19]

de Chazal

[11] Patent Number: 5,873,762

[45] **Date of Patent: *Feb. 23, 1999**

[54] PLAYING STRUCTURE AND MODULES THEREFOR

[75] Inventor: Robert de Chazal, Edmonton, Canada

[73] Assignee: 550058 Alberta Limited, Calgary, Canada

[ * ] Notice: The term of this patent shall not extend beyond the expiration date of Pat. No. 5,417,603.

[21] Appl. No.: 417,070

[22] Filed: Apr. 4, 1995

Related U.S. Application Data

[63] Continuation-in-part of Ser. No. 61,315, May 14, 1993, Pat. No. 5,417,603, which is a continuation-in-part of Ser. No. 13,324, Feb. 4, 1993, abandoned.

[51] Int. Cl.[6] ..... A63H 33/04; A47B 57/00

[52] U.S. Cl. ..... 446/75; 446/85; 108/62; 273/309

[58] Field of Search ..... 446/75, 85, 444, 446/124, 111; 273/309, 157 R; 434/72, 150–152; 108/62, 50, 64, 90, 111; 238/10 B

[56] References Cited

U.S. PATENT DOCUMENTS

| | | | |
|---|---|---|---|
| 2,674,813 | 4/1954 | Hutchinson . | |
| 3,236,003 | 2/1966 | Flood, Jr. | 108/64 X |
| 3,624,956 | 12/1971 | Dunn et al. | 446/111 |
| 3,674,271 | 7/1972 | De Gelder et al. . | |
| 3,871,655 | 3/1975 | Zimmers et al. . | |
| 3,953,032 | 4/1976 | Moore et al. . | |
| 4,192,083 | 3/1980 | Rebbeck | 108/64 X |
| 4,346,889 | 8/1982 | Barlow et al. . | |
| 4,484,749 | 11/1984 | Charney . | |
| 4,534,566 | 8/1985 | Ferris et al. . | |
| 4,552,362 | 11/1985 | Oake . | |
| 4,556,213 | 12/1985 | Sharma . | |
| 4,569,527 | 2/1986 | Rosenwinkel et al. . | |
| 4,696,476 | 9/1987 | Eplett | 274/241 |
| 4,733,867 | 3/1988 | Kemp et al. . | |
| 4,739,992 | 4/1988 | May . | |
| 4,953,786 | 9/1990 | Arsenault | 238/10 B |

FOREIGN PATENT DOCUMENTS

| | | |
|---|---|---|
| 1301456 | 12/1962 | France . |
| 828518 | 2/1960 | United Kingdom . |
| WO 8505282 | 12/1985 | WIPO . |

*Primary Examiner*—Robert A. Hafer
*Assistant Examiner*—Jeffrey D. Carlson
*Attorney, Agent, or Firm*—Fitzpatrick, Cella, Harper & Scinto

[57] ABSTRACT

A playing structure in one embodiment comprises a plurality of playing structure modules arranged in an array. Each of the playing structure modules includes a re-orientatable top having at least two major sides, each of the at least two major sides constituting a playing surface. The playing surface on each major side of the re-orientatable top depicts a different scene. A support frame supports the re-orientatable top above the surface on which the support frame is located in a manner such that one of the playing surfaces is upwardly presented. The re-orientatable tops of the playing structure modules in the array are first arrangeable such that the scene over the upwardly presented playing surfaces of adjacent playing structure modules is continuous and visually fluid. The scene on at least one playing surface of a re-orientatable top has less than four-fold symmetry such that the scene is continuous and visually fluid over the upwardly presented playing surfaces of adjacent playing structure modules when the re-orientatable top of that at least one playing structure module is re-orientated about a bisector passing through the center of the re-orientatable top to present upwardly the other of the playing surfaces of the re-orientatable top.

20 Claims, 18 Drawing Sheets

332
340
332
322
320
318
330
316
314
318
322
330

318
322
322
324
330
334
330
340
342
316
316

PLAYING STRUCTURE AND MODULES THEREFOR

This is a CIP of Ser. No. 08/061,315 filed May 14, 1993, now U.S. Pat. No. 5,417,603 which is a CIP of Ser. No. 08/013,324 filed Feb. 4, 1993, now abandoned.

FIELD OF THE INVENTION

The present invention relates to children's toys and in particular to a playing structure on which toys may be placed and moved thereon.

BACKGROUND OF THE INVENTION

Many children's toys are available which allow a child to build structures such as houses and the like and in effect create cities. Of the toys of this nature, one of the most common are building blocks commonly referred to as Lego®. These building blocks are best assembled on a playing surface where the child can move miniature vehicles, people and animals and rearrange the built structures.

Unfortunately children have very few supportive and convenient places to play with the above type of toys. In most households, the playing surface referred to above is constituted by a free space on a hardwood floor, an unoccupied table top or desk surface and in some instances the top of a bed. Each of these types of playing surfaces when used for play is limited and is inconvenient in some way. Moreover, these playing surfaces do not encourage or suggest directions for a child's fantasy. It is solely up to the child's imagination to transform the otherwise plain surface into one which depicts a scene and/or has a varying topography.

To alleviate some of the above-mentioned problems, playing surfaces having printed presentations on which toys are to be moved have been considered. For example, U.S. Pat. No. 3,206,887 to Eyler et al discloses a children's toy in the form of a pad having a number of pages. Printed on one side of most of the pages in the pad are roadways while on the other pages are representations of vehicles which can be punched out from the pages. The pages with roadways printed thereon also have different locations of interest drawn on them and a legend indicating the drawn area of interest. The roadways are drawn on the sheets in a manner so that the roadway is continuous when two sheets are properly oriented and placed side by side. Although this provides a playing surface with roadways, the surface itself is relatively plain and does not resemble real terrain. Moreover, the symmetry of the roadways printed on the sheets significantly limits the possible scenic variations that can be created. In addition, the planar nature of the sheets requires an underlying support and therefore, this toy still suffers from many of the disadvantages discussed previously.

It is therefore an object of the present invention to provide a novel playing structure and a module therefor.

SUMMARY OF THE INVENTION

According to one aspect of the present invention there is provided a playing structure comprising:

a plurality of playing structure modules arranged in an array, each of said playing structure modules including a re-orientatable top having at least two major sides, each of said at least two major sides constituting a playing surface, the playing surface on each major side of said re-orientatable top depicting a different scene; and a support for supporting said re-orientatable top above the surface on which said support is located in a manner such that one of said playing surfaces is upwardly presented, wherein the re-orientatable tops of said playing structure modules in said array are first arrangeable such that the scene over the upwardly presented playing surfaces of adjacent playing structure modules is continuous and visually fluid, the scene on at least one playing surface of a re-orientatable top having less than four-fold symmetry such that the scene is continuous and visually fluid over the upwardly presented playing surfaces of adjacent playing structure modules when the re-orientatable top of the at least one playing structure module is re-orientated about a bisector passing through the centre of said re-orientatable top to present upwardly the other of the playing surfaces of the re-orientatable top.

According to another aspect of the present invention there is provided a playing structure comprising:

a playing structure module including a re-orientatable top constituted by a plurality of re-orientatable top elements, each of said top elements having a playing surface on both of its major sides, the playing surface on each major side of said re-orientatable top elements depicting a different scene; and a support for supporting said re-orientatable top above the surface on which said support is located in a manner such that one of said playing surfaces of each top element is upwardly presented, wherein the re-orientatable top elements are first arrangeable such that the scene over the upwardly presented playing surfaces of the re-orientatable top elements is continuous and visually fluid, the scene on at least one playing surface of a re-orientatable top element having less than four-fold symmetry such that the scene is continuous and visually fluid over the upwardly presented playing surfaces of the re-orientatable top elements when that re-orientatable top element is re-orientated about a bisector passing through the centre of said at least one re-orientatable top element to present upwardly the other of the playing surfaces of that re-orientatable top element.

According to yet another aspect of the present invention there is provided a playing structure module comprising:

a re-orientatable top having a playing surface on both of its major sides; and a support frame for supporting said re-orientatable top above the surface on which said support frame is located in a manner such that one of said playing surfaces is upwardly presented, said support frame being constituted by a plurality of support frame elements which are assembled to form said support frame without the use of fasteners.

In still yet another aspect of the present invention there is provided a playing structure module comprising:

a re-orientatable top having a playing surface on both of its major sides; and a support frame for supporting said re-orientatable top above the surface on which said support frame is located in a manner such that one of said playing surfaces is upwardly presented, said re-orientatable top including a pair of separable elements each of which defines one of said playing surfaces, at least one of said elements being generally transparent, said elements being configured to define an interior space therebetween to allow an individual to create a desired scene on said re-orientatable top within said interior space, said scene being visible through said at least one generally transparent element.

The present invention provides advantages in that the re-orientatable top of each playing structure module allows different scenes to be created while maintaining the visual fluidity of the overall scene of the playing structure. Also, because the playing structure modules can be arranged with other playing structure modules, different size scenes can be created making the variety and size of created scenes virtually limitless. Because of this, the present invention forms a stage which provides direction and focus for a child's imagination. Also, because the playing surfaces on the re-orientatable tops of the playing structure modules are raised from the ground, the playing surfaces are at a convenient physical height for most children. More importantly, the toys placed on the playing structure are raised so that the child's point of view is as if he or she is among them.

In addition, the present invention provides further advantages in that children's toys remain on the playing structure and may be stored on the playing surface or on a storage shelf when the child is finished playing. This avoids the problem associated with children spreading their toys around the household and speeds up the cleaning process significantly. Also, the design of the playing structure modules allows the modules to be stacked facilitating compact storage and house cleaning.

BRIEF DESCRIPTION OF THE DRAWINGS

Embodiments of the present invention will now be described more fully with reference to the accompanying drawings in which.

DESCRIPTION OF THE PREFERRED EMBODIMENTS

Figure 1:
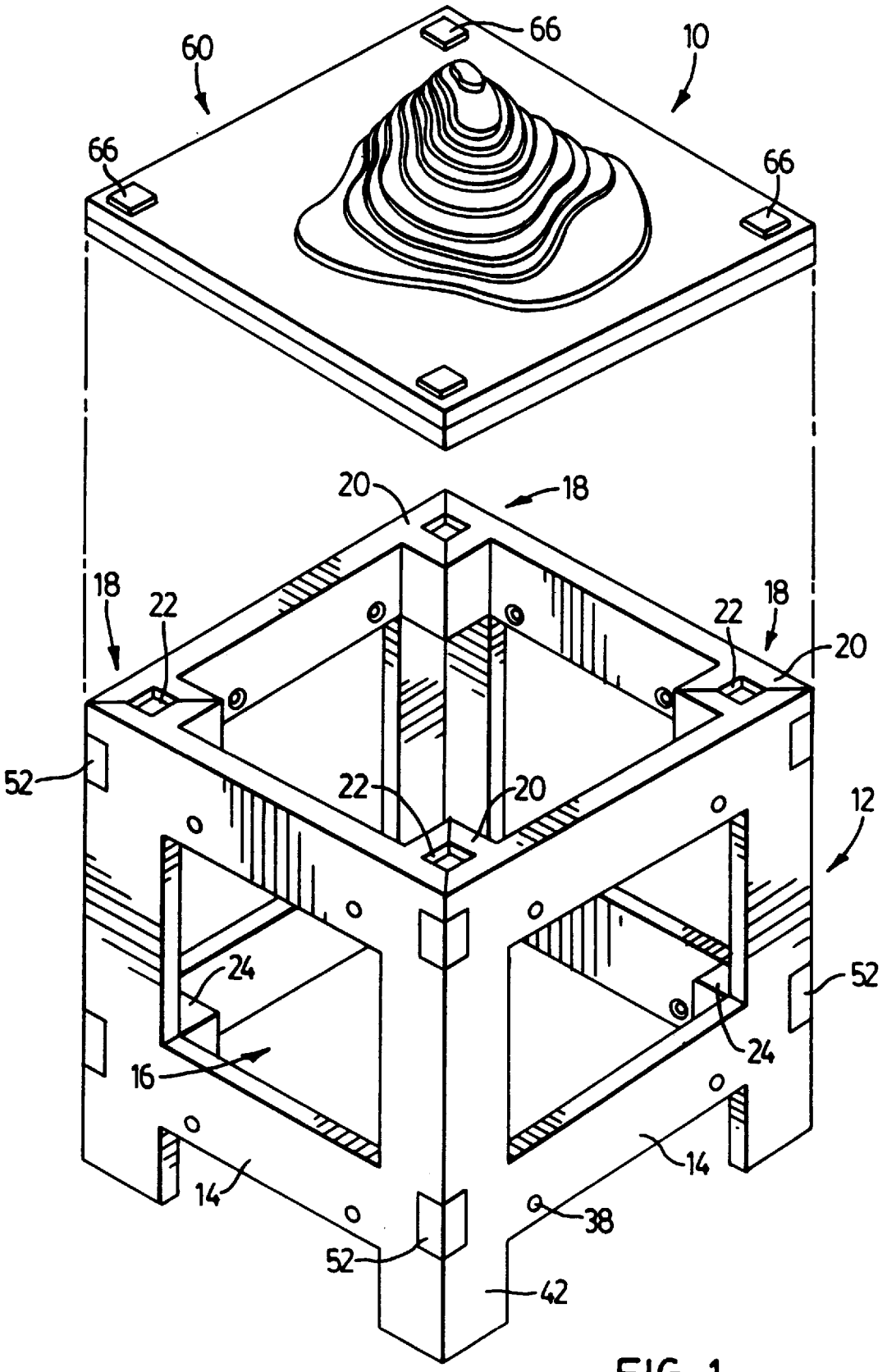
FIG. 1 is a perspective view of a playing surface module with its re-orientatable top lifted therefrom.

Referring now to FIG. 1, a playing structure module is shown and is generally indicated by reference numeral 10. The module 10 includes a box-like support frame 12 constituted by four interlocking frame elements 14 and having an open interior to define a storage space 16. At the four corners of the support frame 12 adjacent its top are square support surfaces 18. The upper surfaces 20 of the support surfaces 18 have square recesses 22 formed in them. Similar square support surfaces 24 are located at the corners of the frame 12 intermediate the top and bottom thereof with the support surfaces 24 being located nearer the bottom of the support frame 12. The support surfaces 24 do not have recesses formed in them but support a storage shelf 26 (see FIG. 5).

Figure 2:
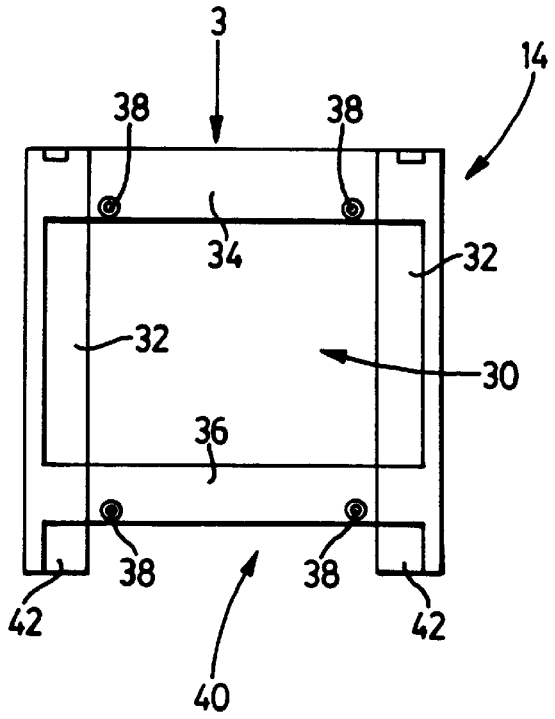
FIG. 2 is a side elevation view of a frame element of the module of FIG. 1.
Figure 3:
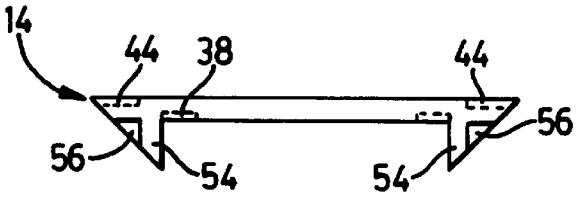
FIG. 3 is a top plan view of the frame element shown in FIG. 2.

Referring now to FIGS. 2 and 3, one of the frame elements 14 is better illustrated although it should be apparent that all of the frame elements 14 of the support frame 12 are identical. As can be seen, each frame element 14 is rectangular when viewed from the side and includes a pair of laterally spaced, upstanding side panels 32 bridged by vertically spaced, horizontal, upper and lower panels 34 and 36 respectively. The spacing between the side panels 32 and the upper and lower panels 34 and 36 defines an opening 30. Holes 38 are provided through the upper and lower panels 34, 36 respectively at spaced locations. The lower panel 36 is raised from the lower edge of the side panels 32 to form a rectangular notch 40 and to define a pair of legs 42.

Figure 4:
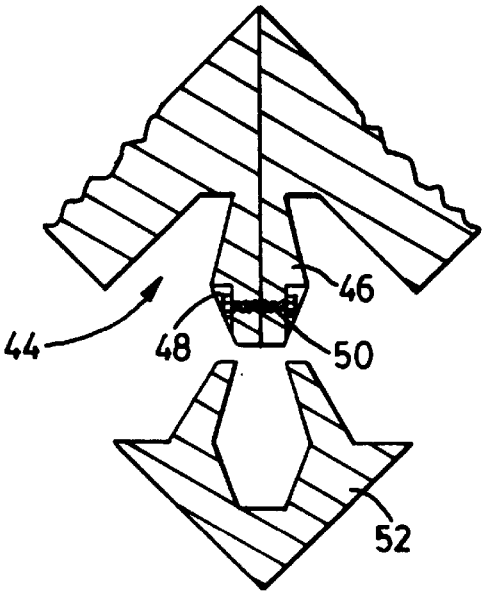
FIG. 4 is a sectional view of a portion of the playing structure module shown in FIG. 1.

Vertically spaced notches 44 are formed in the side panels 32 adjacent the outer edges thereof (see FIGS. 3 and 4). The notches 44 align with the notches 44 formed in adjacent frame elements 14 when the frame elements 14 are assembled to form the support frame 12. The notches 44 are shaped to define projections 46 at the corners of the support frame 12. The projections 46 have holes 48 provided through them which align with the holes 48 formed in the projections 46 of the adjacent frame elements 14 when the frame elements 14 are assembled to form the support frame 12. A fastener 50 passes through the holes 48 to secure the frame elements 14 together at right angles to one another. The notches 44 receive plastic clips 52 which snap over projections 46 and conceal the notches 44.

Triangular projections 54 extend from the side panels 32 just below the bottom edge of the opening 30 and at the top thereof and constitute one half of the support surfaces 24 and 18 respectively. The projections 54 at the top of the side panels 32 have triangular recesses 56 formed in them and constitute one-half of the recesses 22.

Removably supported on the support frame 12 is a re-orientatable top having playing surfaces 62, 64 on its opposed major sides. On each playing surface near its four corners are square projections 66 sized to be received in the apertures 22 to inhibit the re-orientatable top 60 from sliding when properly positioned on the support frame 12. In this particular embodiment, each playing surface 62, 64 includes a multi-coloured topographic scene thereon which may be two or three-dimensional. The topographic scenes are suggestive of a predetermined landscape or architecture but are not too specific allowing children to get more variety since they can easily redefine the landscapes for their own imaginative purposes. The scenes include scenic elements which are defined by and share boundary lines. Opposed ends of the boundary lines extend to and are truncated by side edges of the scenes. In the case of three-dimensional topographic scenes, the topography on each playing surface 62, 64 is also stepped to provide generally planar, horizontal surfaces at different elevations and to minimize inclined surfaces. This provides playing platforms for miniature people, animals and vehicles used during a child's play.

The topographic scene on each playing surface 62, 64 is different although in the case of three-dimensional topographic scenes, the topographies on the opposed playing surfaces are basically complimentary in configuration. For example, the playing surface 62 has a landscape on it which resembles a mountain. On the opposite playing surface 64 which is unseen in FIG. 1 but which can be seen in FIG. 5, the landscape of the topographic scene resembles an open-pit mine. Other re-orientatable tops 60 may, for example, have ancient ruins on one playing surface 62 and a mountainous road on the opposite playing surface 64.

The landscape and colouring of the scenes on the playing surfaces 62, 64 of one top 60 are designed to interact with the scenes on the playing surfaces 62, 64 of other tops on other playing structure modules 10.

Figure 5:
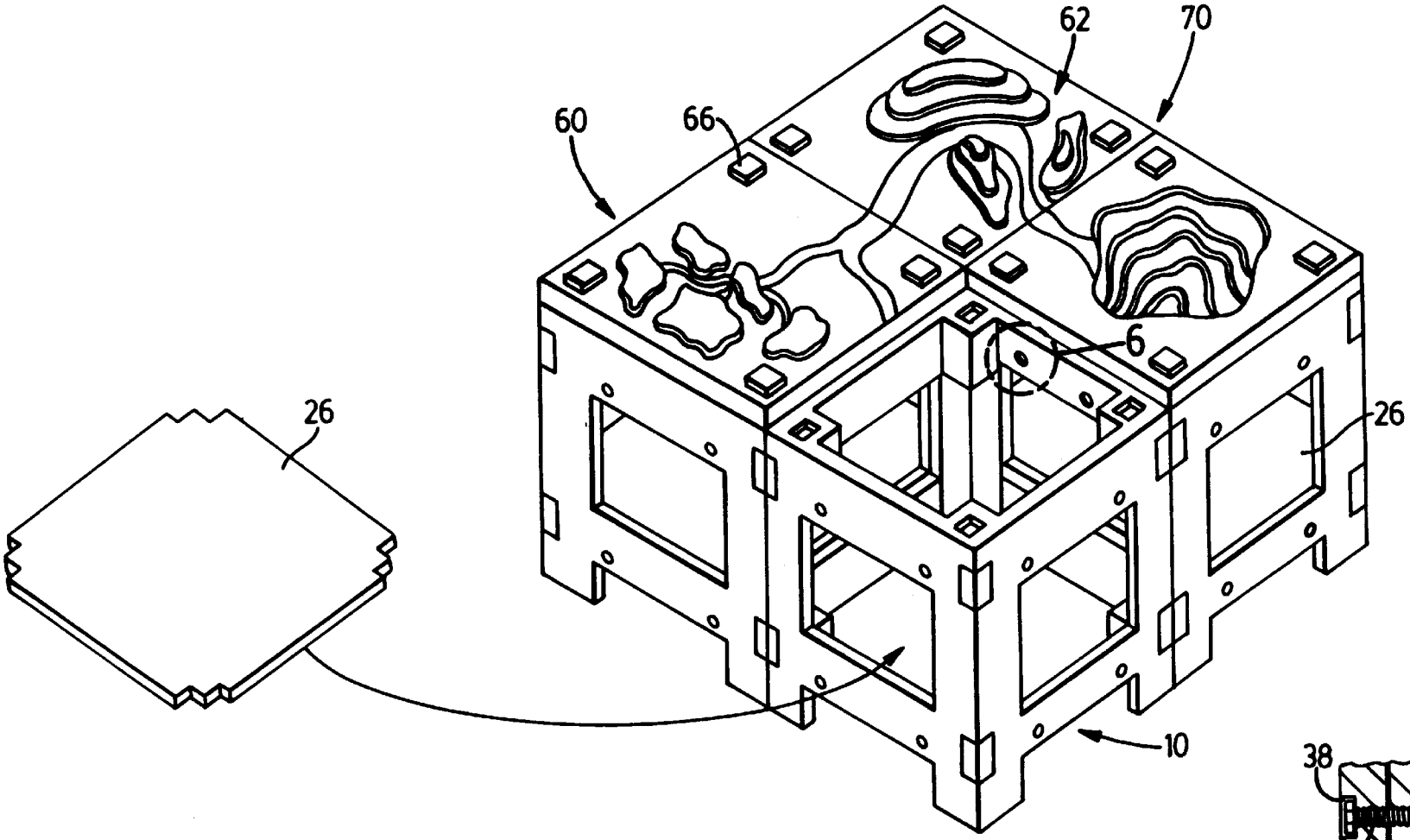
FIG. 5 is a perspective view of a playing structure formed from a plurality of playing structure modules of the type shown in FIG. 1.
Figure 6:
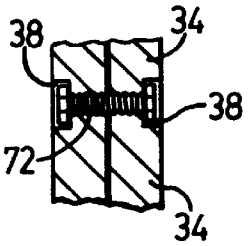
FIG. 6 is a sectional view of a portion of the playing structure shown in FIG. 5.

FIG. 5 shows a playing structure 70 formed from a plurality of playing structure modules 10 arranged to form an array. When the playing structure modules are arranged in this manner, the holes 38 in the upper and lower panels 34 and 36 respectively of adjacent playing structure modules 10 align. Fasteners 72 are passed through the aligned holes 38 in adjacent panels to secure the playing structure modules 10 and prevent relative movement between them (see FIG. 6).

To permit many different playing structure scenes to be created, the playing structure modules 10 are made in sets with, in this example, each set including six playing structure modules 10. The sets of playing structure modules 10 have different scenes on their tops 60 and represent different worlds. Therefore, one set of playing structure modules may represent for example, an "Ancient World" while other sets may represent a "Dinosaur World" and a "City World" respectively.

Figure 7:
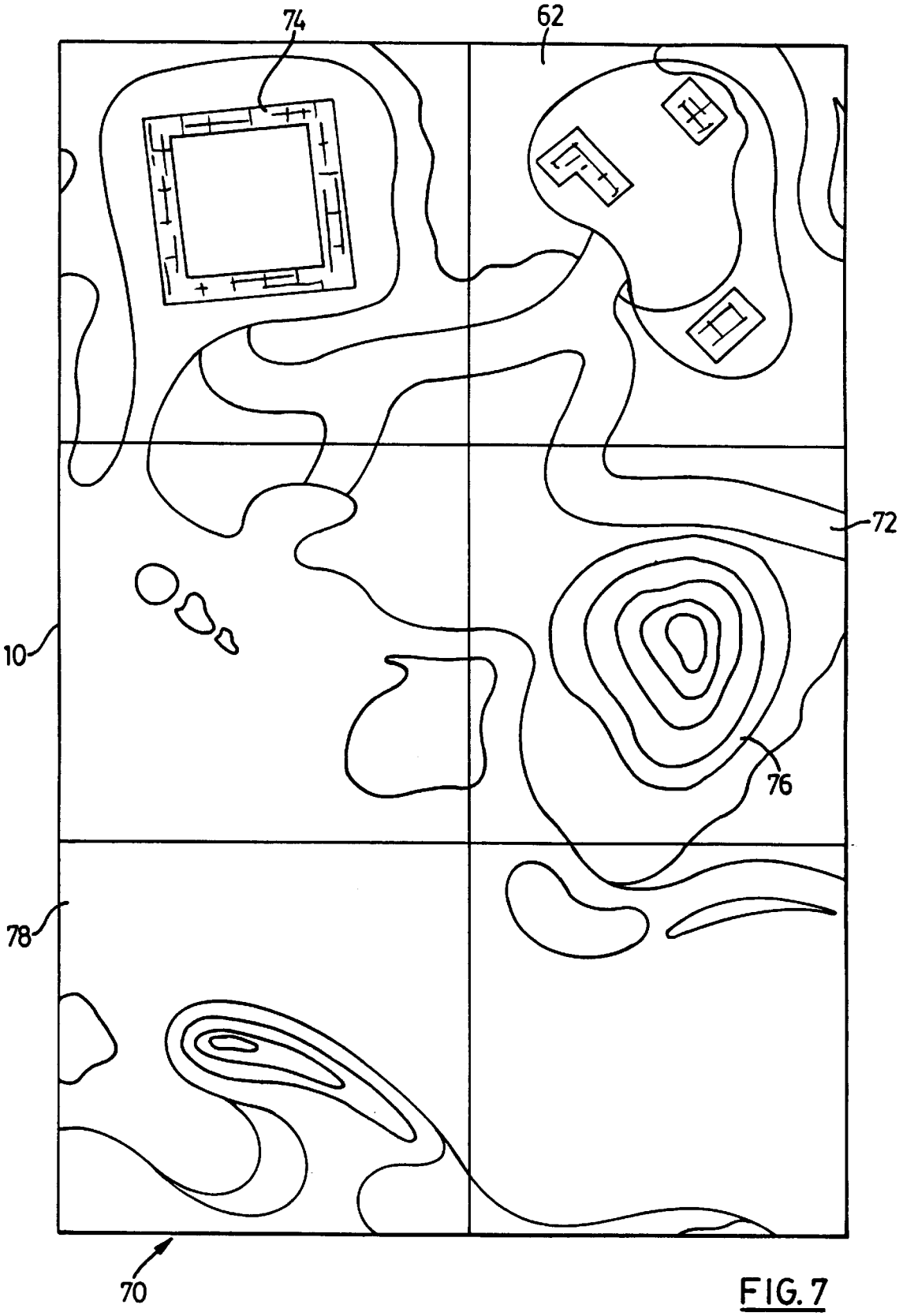
FIG. 7 is a top plan view of a playing structure formed from an array of six playing structure modules.

FIG. 7 shows one set of playing structure modules 10 interconnected in a 3×2 array to form a playing structure 70 having a visually fluid, continuous scene. The scene includes a road 72 which winds across four of the playing surfaces 62. A platform 74 surrounded by water on one of the playing surfaces provides an ideal location for a toy castle surrounded by a moat. A mountain 76 is also provided on one playing surface 62 while a continuous waterway 78 extends across five of the six playing surfaces 62 in the set.

Figures 9A, 9B:
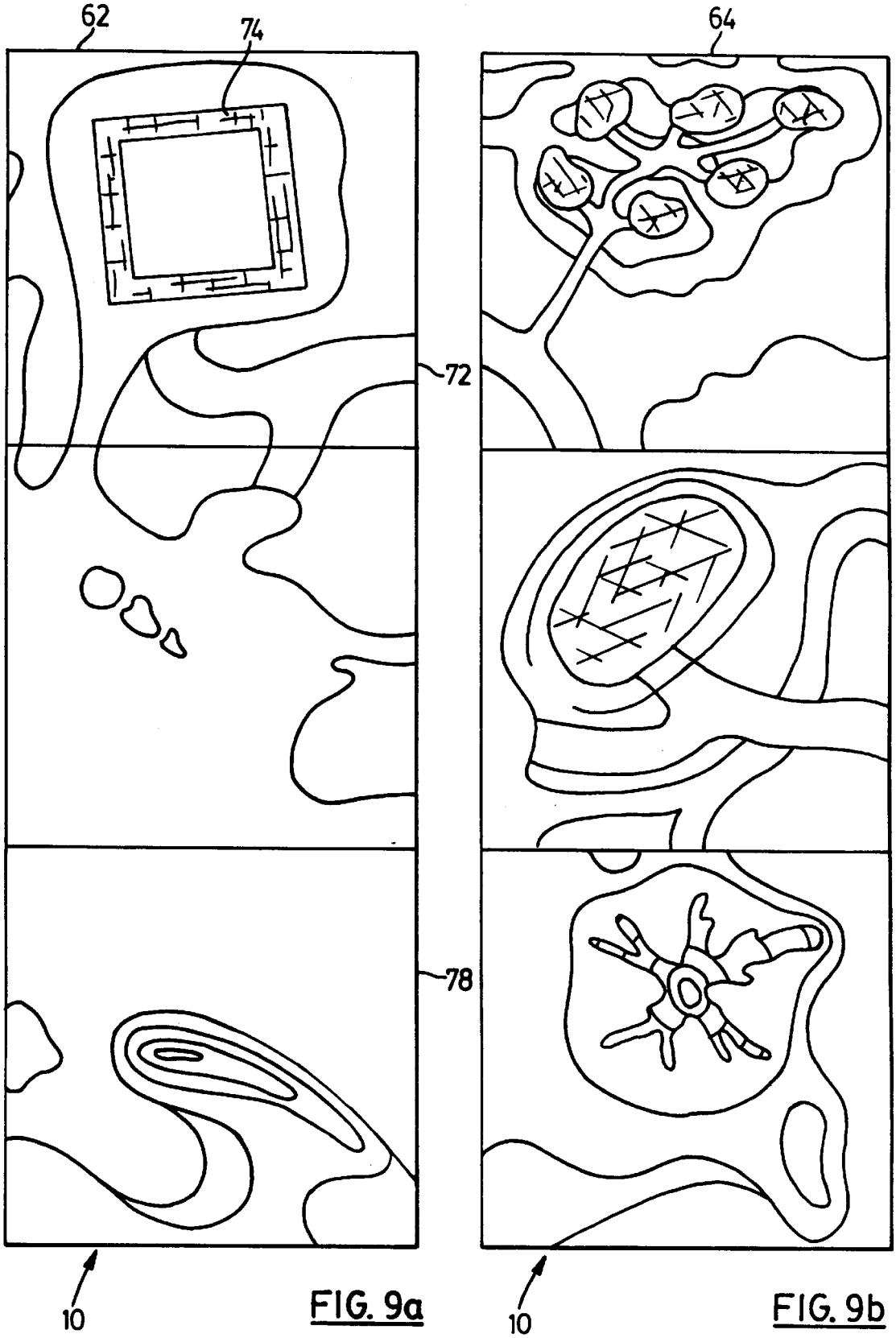
FIG. 9*a* is a top plan view of one column of the array of playing structure modules illustrated in FIG. 7.
FIG. 9*b* is a bottom plan view of the re-orientatable tops of the playing structure modules shown in FIG. 9*a;*
Figures 10A, 10B:
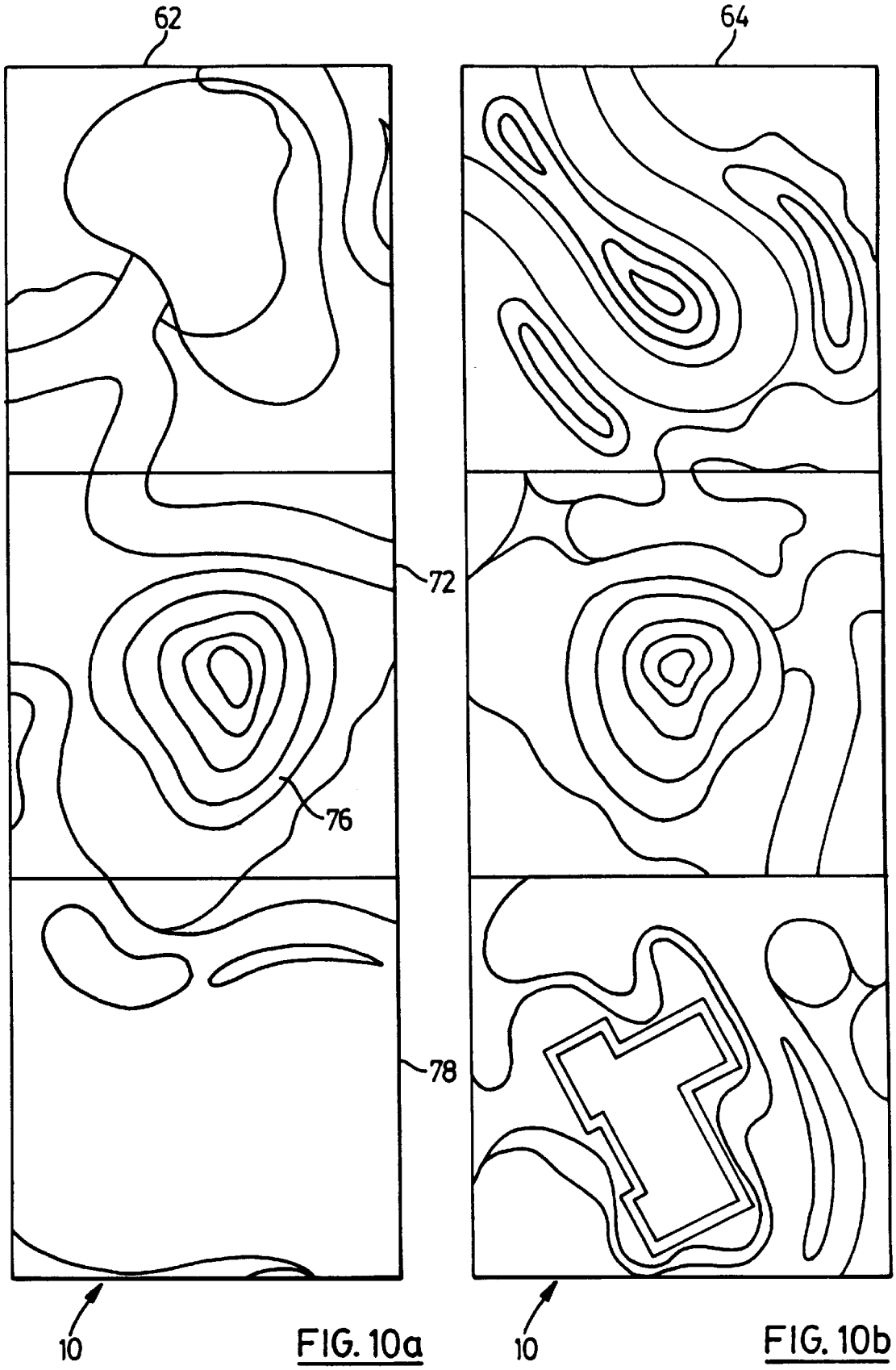
FIG. 10*a* is a top plan view of the other column of the array of playing structure modules illustrated in FIG. 7.
FIG. 10*b* is a bottom plan view of the re-orientatable tops of the playing structure modules shown in FIG. 10*a;*

FIG. 9*a* shows the playing structure modules 10 forming the first column of the array in FIG. 7 while FIG. 9*b* shows the playing surfaces 64 of the re-orientatable tops 60 of those same playing structure modules 10 which face the shelf 26 and remain unseen. Similarly, FIG. 10*a* shows the playing structure modules 10 forming the second column of the array in FIG. 7 while FIG. 10*b* shows the playing surfaces 64 of the re-orientatable tops 60 of those same playing structure modules 10 which face the shelf 26 and remain unseen.

The topographic scene on each playing surface of the playing structure modules 10 in each set are designed to exhibit a certain symmetry so that different continuous, visually fluid scenes can be formed by re-orientating one or more of the tops 60. Specifically, the scenes on each playing surface of at least one of the playing structure modules are designed so that they have less than four-fold symmetry and so that the scene over adjacent playing surfaces still remains continuous and visually fluid when the top of that at least one module is re-orientated about a bisector passing through the centre of the re-orientatable top to present upwardly its other playing surface. This is achieved by ensuring that the end points of the boundary lines along the side edges of the scenes are unsymmetrical along the side edges about center points thereof. In this particular embodiment, the scenes on each playing surface of all of the playing structure modules are designed so that they have two-fold symmetry and so that the scene over adjacent playing surfaces remains continuous and visually fluid when any top is re-orientated about a diagonal bisector.

Figure 12:
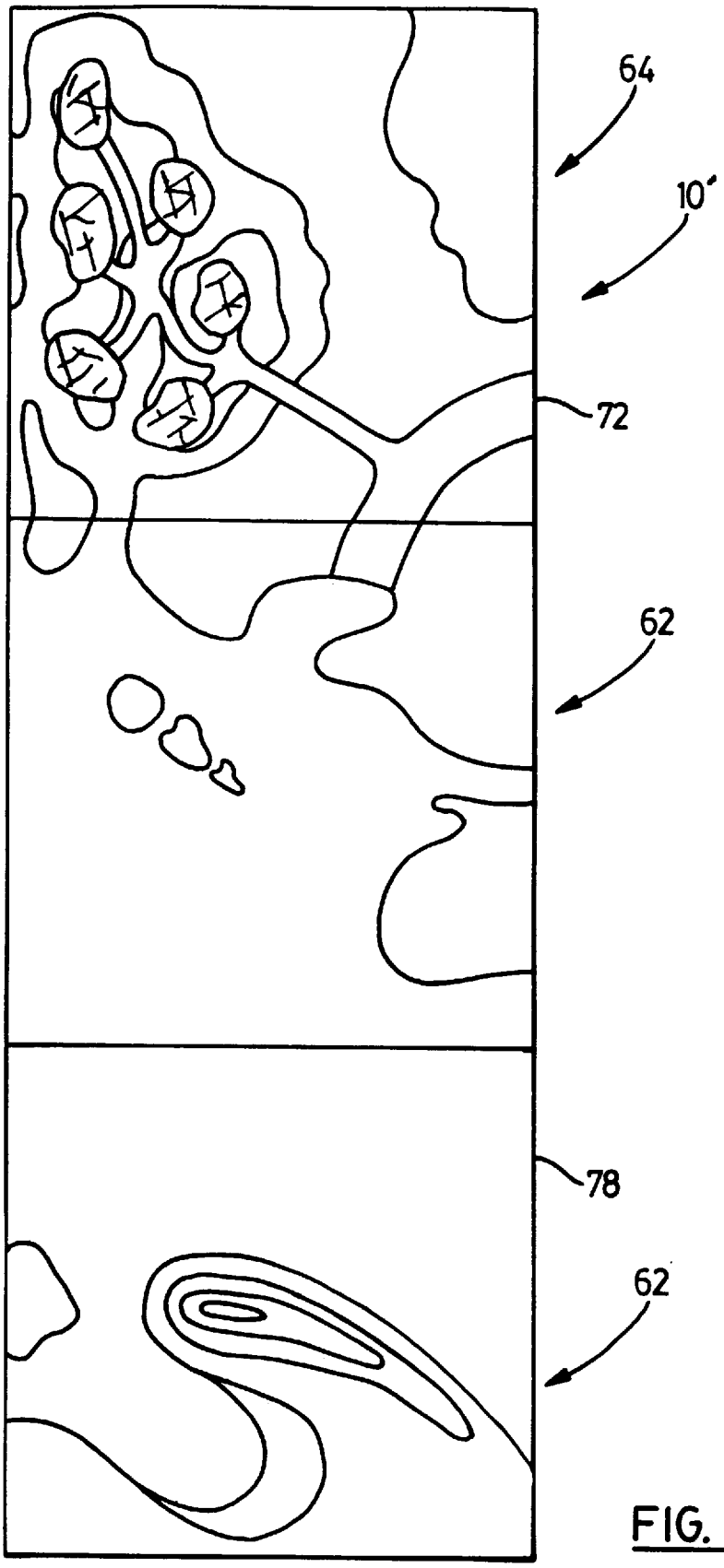
FIG. 12 is a top plan view of the one column illustrated in FIG. 9*a* with the re-orientatable top of one of the playing structure modules flipped and rotated in the manner shown in FIGS. 11*b* and 11*c* respectively.

FIG. 12 shows a top plan view of the column of playing structure modules 10 illustrated in FIG. 9*a* with the top 60 of the uppermost playing structure module 10' reversed along a North-West, South-East diagonal bisector. As can be seen, the resulting scene of the three playing structure modules in the column 10 is still continuous and visually fluid although the castle platform 74 has been replaced by roads and bridges 80 which extend to islands and terminate at smaller platforms 82.

Figure 11A:
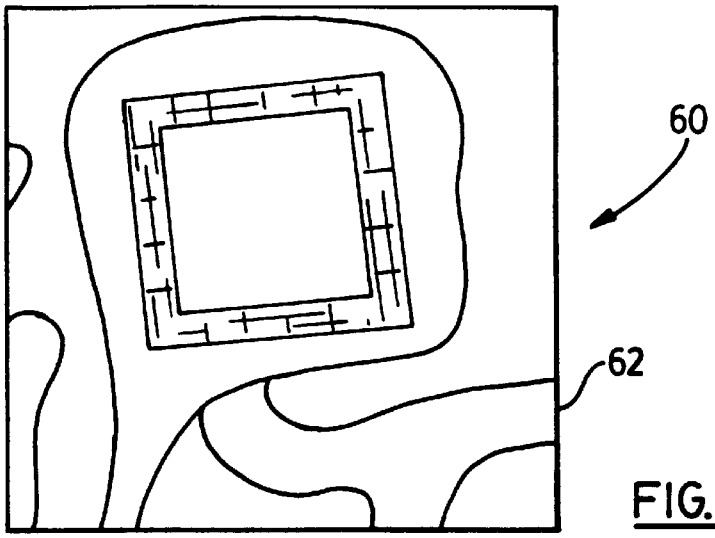
FIGS. 11*a*, 11*b* and 11*c* show top plan views of one of the re-orientatable tops of a playing structure module forming part of the playing structure of FIG. 7 in a first condition, flipped over along an east-west axis and rotated counter-clockwise by 90° respectively.
Figure 11B:
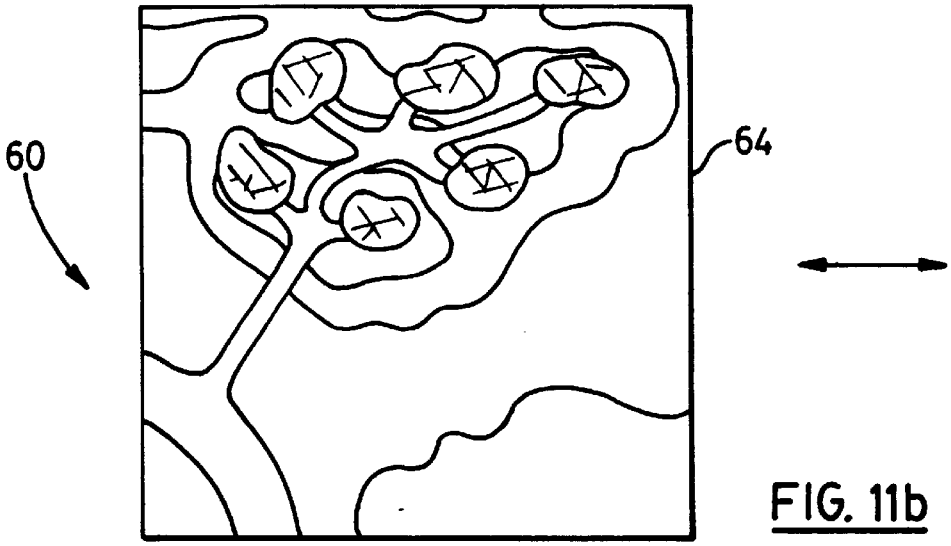
Figure 11C:
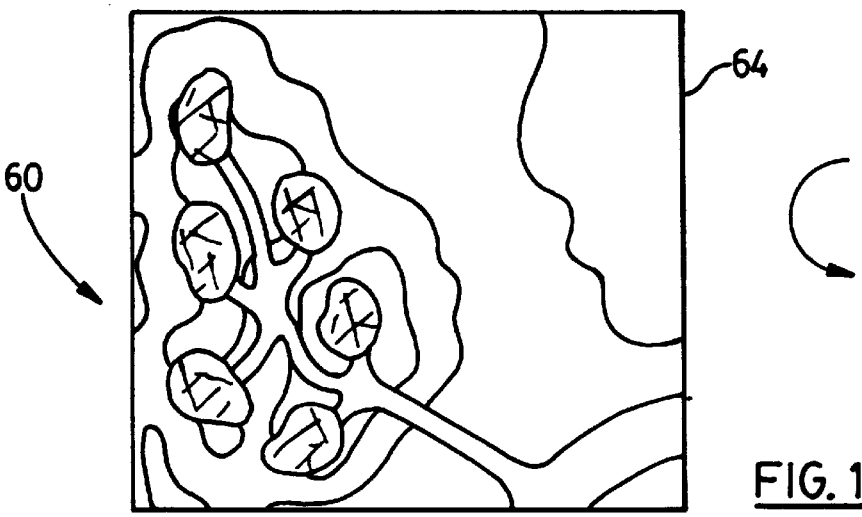

FIGS. 11*a*, 11*b* and 11*c* show the manner in which the top 60 of the playing structure module 10' is re-orientated to create the scene illustrated in FIG. 12. In particular, when changing the playing structure module from that shown in FIG. 9*a* to that shown in FIG. 12, the top 60 of the playing structure module 10' simply needs to be re-orientated along the North-West, South-East diagonal bisector. This movement of the top is broken down into its constituents in FIGS. 11*b* and 11*c*. Once the top 60 has been re-orientated along its diagonal bisector, the top 60 can be placed on the frame 12 of the playing structure module 10' and the scene will still be visually fluid.

Figure 8:
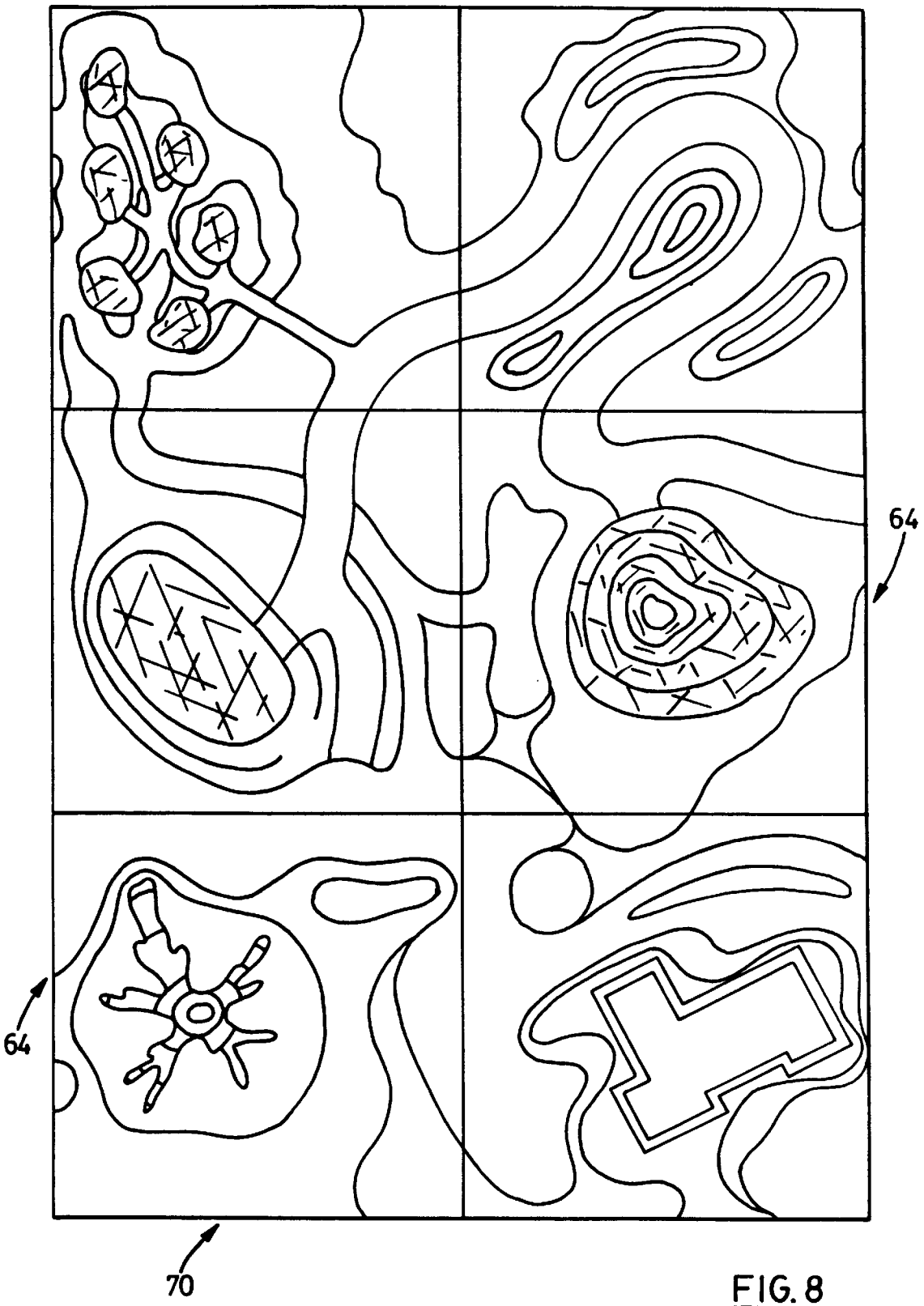
FIG. 8 is a top plan view of the playing structure shown in FIG. 7 with the re-orientatable tops of all of the playing structure modules reversed and rotated.
Figure 13:
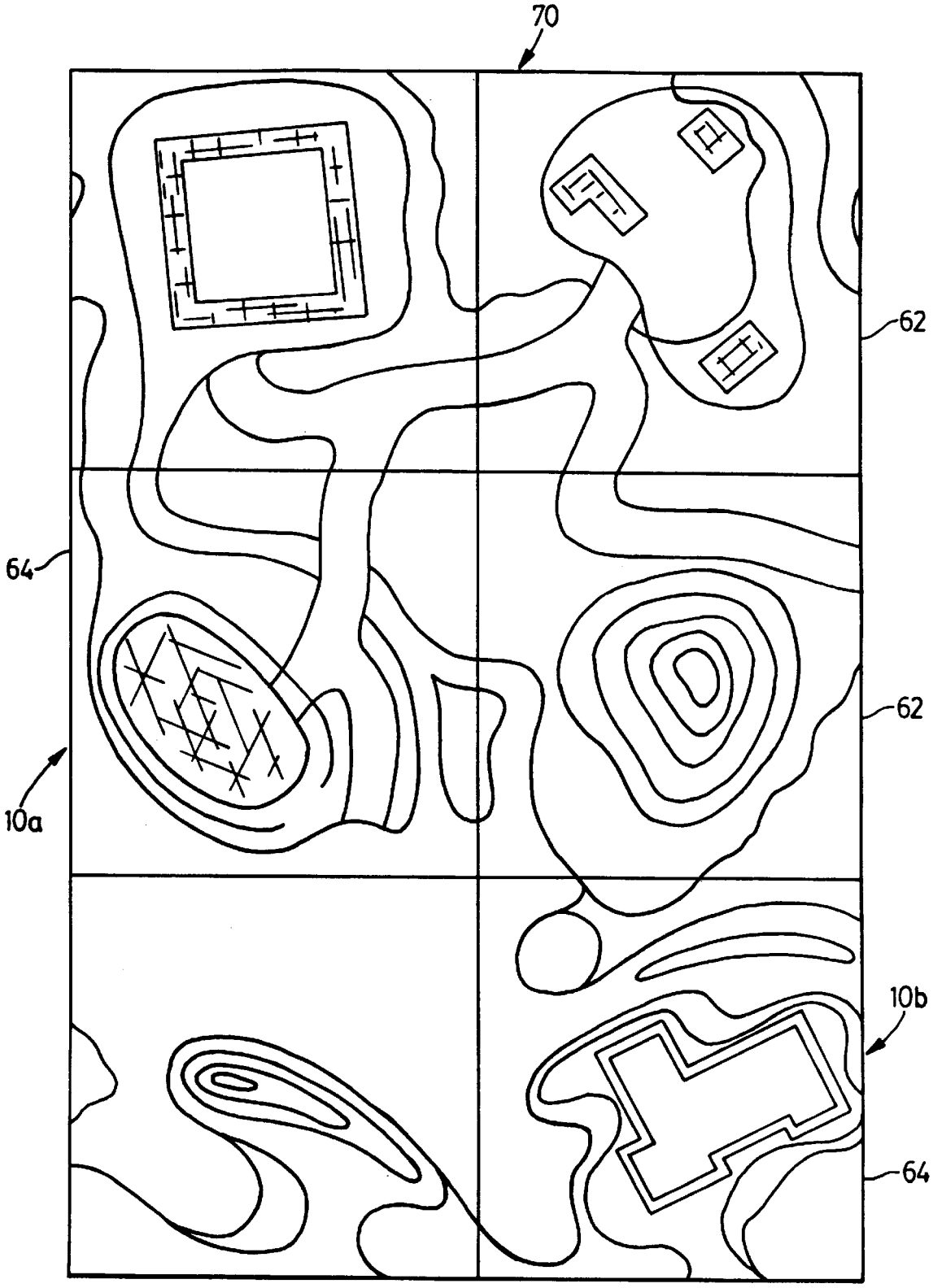
FIG. 13 is a top plan view of the playing structure of FIG. 7 with the re-orientatable tops of two playing structure modules flipped and rotated in the manner shown in FIGS. 11*b* and 11*c* respectively.

FIG. 13 is a top plan view of the playing structure 70 shown in FIG. 7 with the tops 60 of the playing structure modules 10*a* and 10*b* reversed along their North-West, South-East diagonal bisector. FIG. 8 on the other hand shows the playing structure 70 of FIG. 7 with the tops 60 of all of the playing structure modules 10 re-orientated along their North-West, South-East diagonal bisector.

Figure 14:
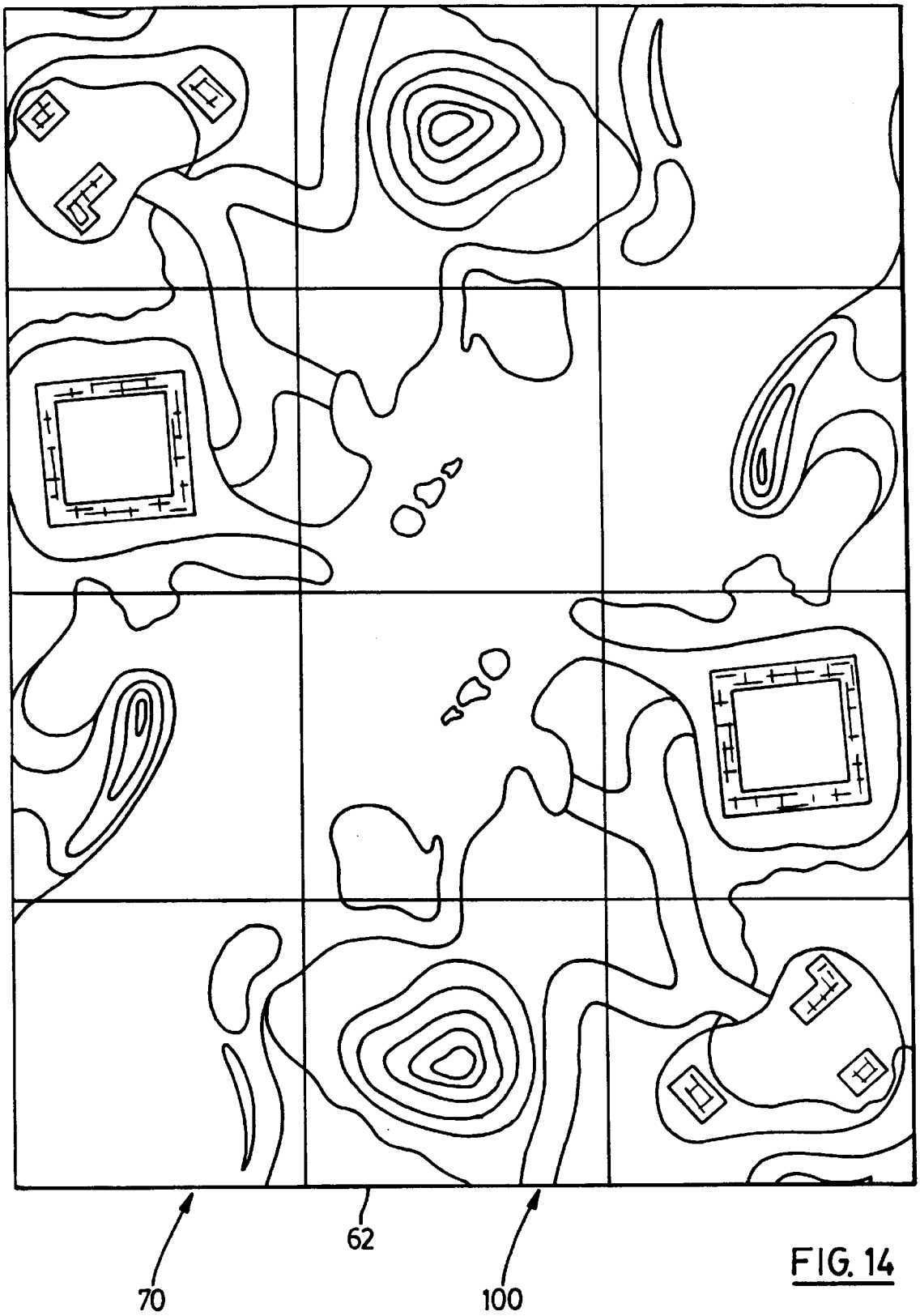
FIG. 14 is a top plan view of a playing structure formed from two arrays of playing structures similar to those shown in FIG. 7.

The scenes depicted on the playing surfaces 62, 64 of the playing surface modules 10 in each set are also designed so that continuous, visually fluid scenes can be created by arranging two or more sets of playing structure modules 10 in a manner to form larger arrays. FIG. 14 shows a top plan view of two identical sets of playing structure modules 10 (the same as the set shown in FIG. 7) arranged to form a larger playing structure 100 while still depicting a continuous, visually fluid scene. As can be seen, to create this scene, one set of playing structure modules 10 has been rotated 180°. It should be apparent that the tops 60 of any one of playing structure modules 10 forming the playing structure 100 may be re-orientated along a diagonal bisector in the manner described previously, to create a new continuous and visually fluid scene. This allows a significant number of different scenes to be created and with the addition of more playing structure modules 10 or sets thereof, the variation of potential scenes is virtually limitless.

Although the design of the scenes in the specific embodiment has been shown as having two-fold symmetry and being re-orientatable about a diagonal bisector, it should be appreciated that other scene configurations can be used. For example, in the case of two-fold symmetry, other bisectors can be chosen such as those which extend between the mid-points of opposed edges of the major sides of the playing surfaces. When different shaped re-orientatable tops are used, the symmetry of the scene may of course be designed to define yet further bisectors.

In use, the various playing structure modules 10 in the set simply need to be arranged within the room in which they are located to form a playing structure having the desired configuration. The fasteners 72 can then be passed through the holes 38 to secure adjacent playing structure modules. The tops 60 of the modules can then be first arranged to create a continuous, visually fluid scene. Once one continuous, visually fluid scene has been created, others are possible by re-orientating any one of tops 60 along a North-West, South-East diagonal bisector. This design of the tops 60 facilitates the creation of different scenes by children using the playing structure.

Once created, toys can be placed on the playing surfaces and moved as desired. In the case of three-dimensional scenes, the varying three-dimensional topography of the individual playing surfaces 62, 64 respectively provides a stage which promotes a child's imagination and entertains them for extended periods of time. When the child is finished playing with the playing structure, the toys can be removed from the playing surfaces and stored on the shelf 26 of one or more playing structure modules. If necessary, after a child is finished playing and the toys are stored on a shelf or shelves 26, the playing structure 70 can be disassembled into the individual playing structure modules 10 and the playing structure modules can be stacked in a convenient location out of the way.

Figure 15:
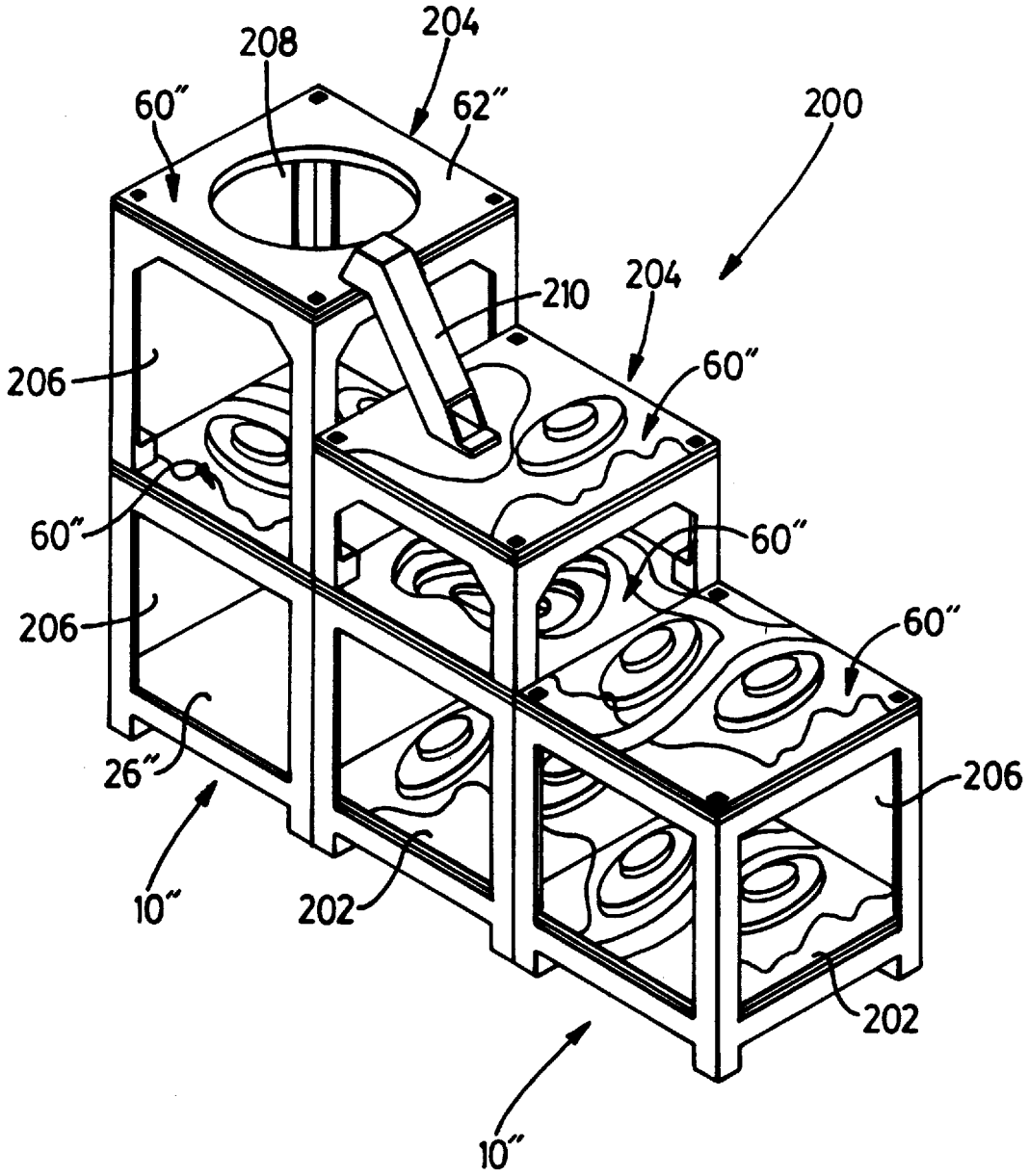
FIG. 15 is a perspective view of another embodiment of a playing structure formed from a plurality of playing structure modules.

Referring now to FIG. 15, an alternative embodiment of an array 200 of playing structure modules is shown. In this embodiment, like reference numerals will be used to indicate like components with a "'" added for clarity. As can been seen, the playing structure modules 10" are stacked not for the purpose of storage, but rather to create a three dimensional playing structure. The lower playing structure modules 10" in the array are basically the same as that shown in FIG. 1. However, on some of the modules 10" in the array 200, the shelf 26" has been replaced with a playing surface 202. Similar to the playing surfaces 62 and 64, the playing surface 202 has a two or three dimensional topographic scene on it which can be arranged to create a visually fluid topographic scene with the playing surfaces 202 on adjacent playing structure modules 10". The playing surface 202 may also be re-orientatable to allow the scene constituted by the playing surfaces 202 to be varied.

On top of at least some of the playing structure modules 10" are other playing structure modules 204 having a slightly different design. The playing structure modules 204 are open on their sides and do not include a shelf. Therefore, when the playing structure modules 204 are placed on top of another playing structure module 10" or 204, the re-orientatable top 60" on that module is exposed. The playing structure modules 204 also have formations on the bottom of their legs which are complimentary to the formations at the corners of the reversible tops 60" to inhibit lateral movement between stacked modules. The playing structure modules 204 may also come in different heights to provide a stepped playing surface as illustrated. Side panels 206 which present graphics consistent with the playing surfaces 202 may be attached to the sides of one or more of the modules 10" and 204".

When creating a three dimensional playing structure 200, the playing surfaces 62", 64" of the re-orientatable tops 60" on at least some of the playing structure modules 204 are provided with ladders, trap doors and the like to provide access to the playing surfaces on the playing structure modules below them. For example, in FIG. 15, one of the playing structure modules 204 has a passage 208 formed in its playing surface 62". A slide 210 extends between the different height modules 204. Although not shown, passages, trap doors and the like may be formed in the playing surfaces of any of the modules 10" and 204 respectively. This arrangement of playing structure modules allows alternative themes to be created. In particular, the playing surfaces 202 and the playing surfaces on the reversible tops 60" of modules 10" on which a module 204 is located, can be designed to have an underground or underwater theme with the playing surfaces of the uppermost playing structure modules having a ground or sea level theme thereon. If side panels 206 are used, they can be coloured to suit the theme of the playing structure 200.

Figure 16:
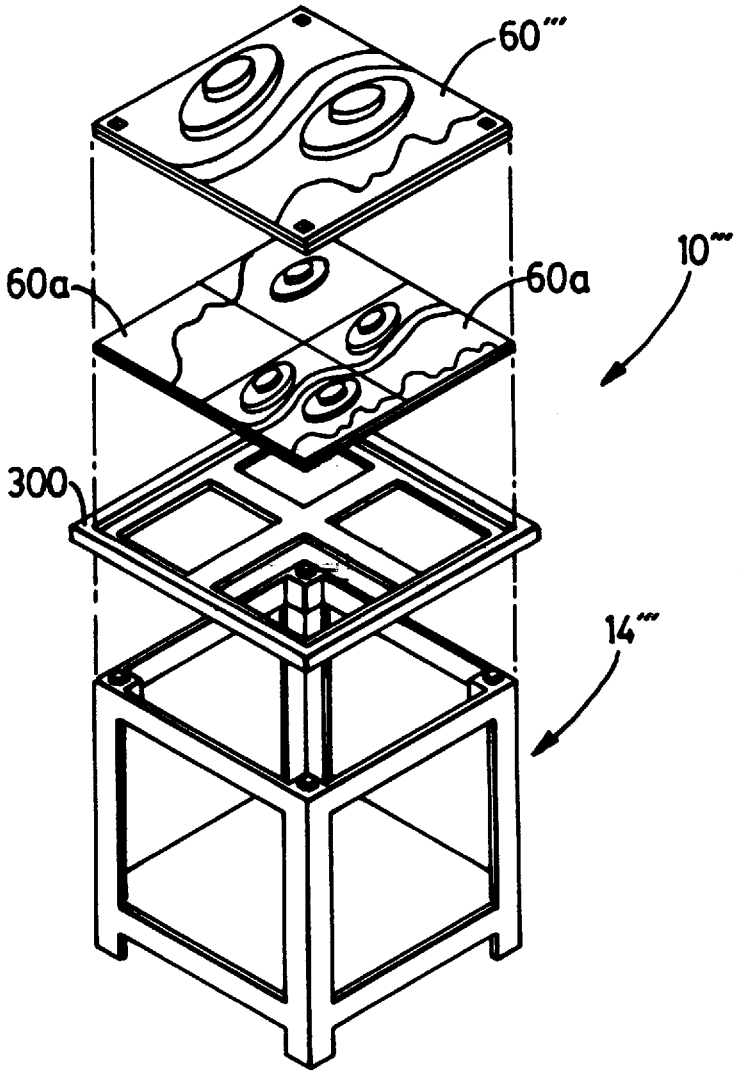
FIG. 16 is an exploded perspective view of another embodiment of a playing structure module.
Figure 17A:
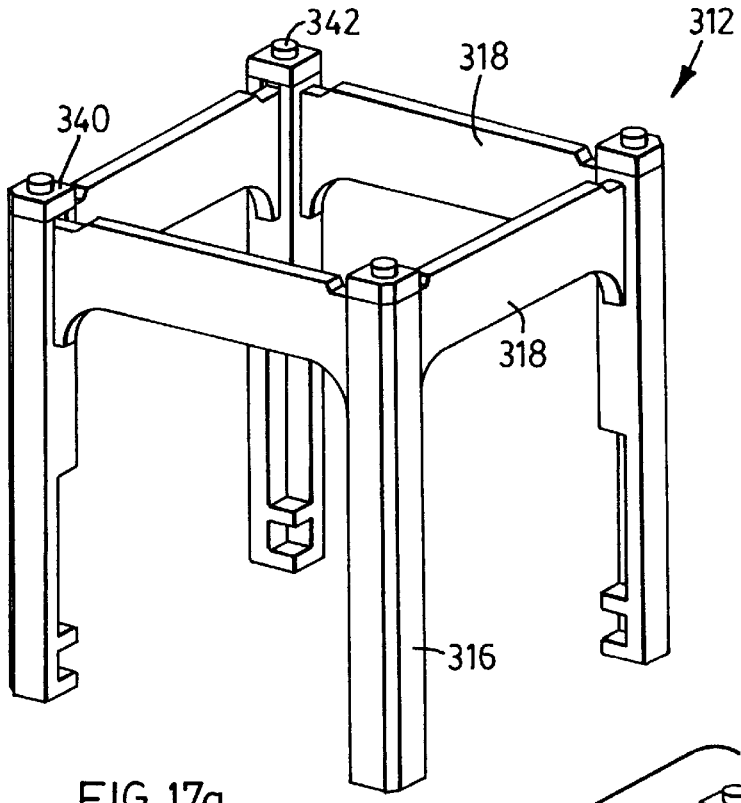
FIGS. 17*a* and 17*b* are perspective views of an alternative embodiment of a support frame for a playing structure module.
Figure 17B:
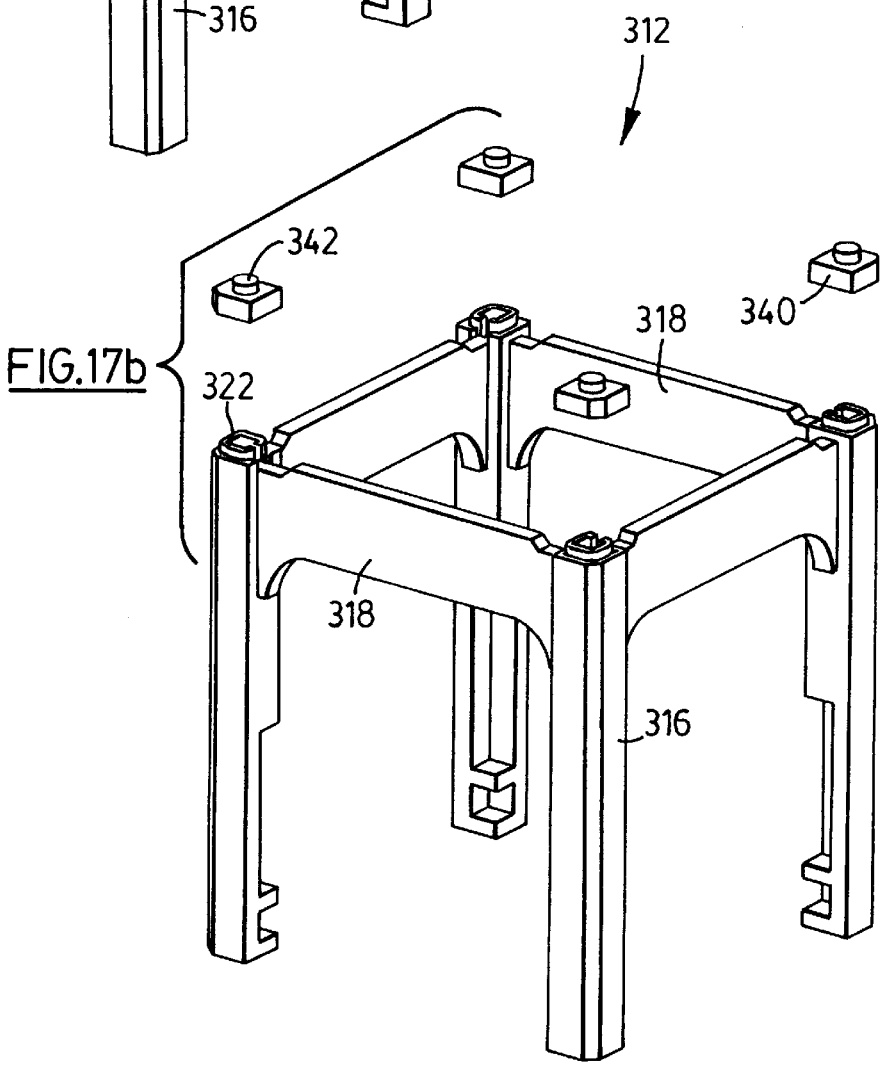
Figures 17C, 17D:
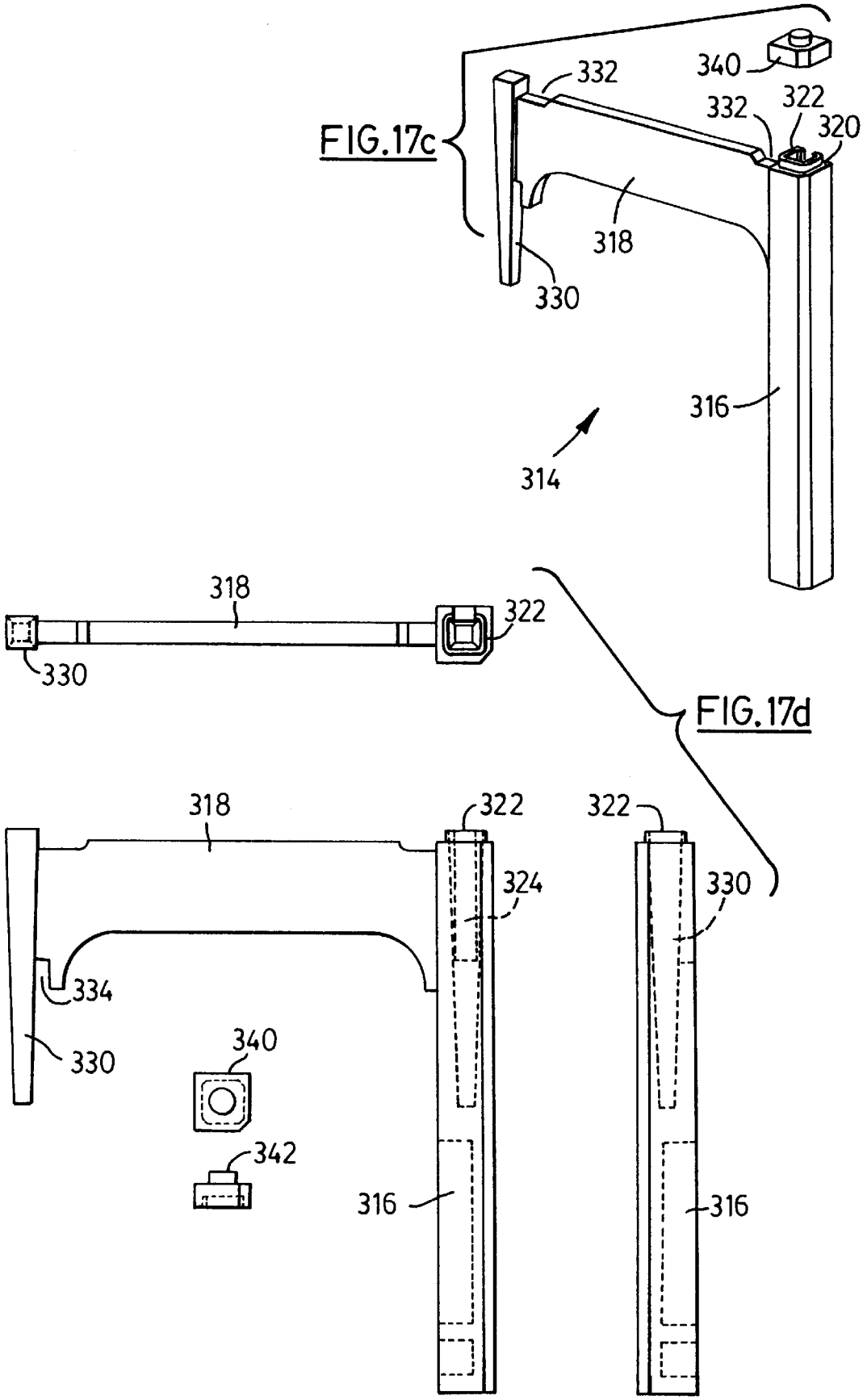
FIG. 17*c* is a perspective view of an element of the support frame shown in FIGS. 17*a* and 17*b;*
FIG. 17*d* shows front, side and top plan view of the element shown in FIG. 17*c;*

Referring now to FIG. 16, yet another embodiment of a playing structure module is shown. In this embodiment, like reference numerals will be used to indicate like components with a "'" added for clarity. The playing structure module 10'" has a re-orientatable top 60'" formed of smaller, re-orientatable top elements 60*a*. Each top element 60*a* has a playing surface on both of its major sides. The re-orientatable top elements 60*a* can be re-arranged in the same manner as the reversible tops 60 to create different scenes on a single playing structure module 10'" of a smaller scale then those of the previous embodiments. When using the top elements 60*a* to form a playing surface on the module, a retention frame 300 is interposed between frame 14" and the top elements.

It has been found that the topographic scenes of the playing structure in combination with the toys a children places thereon suggest directions and presents tensions which children quickly absorb into their play. Also, the playing structure changes when different toys are placed on it and are utilized differently by different children. Not only is the present invention versatile in the sense that the playing surface of the playing structure can be changed but also in that the playing surface of the playing structure changes depending on the types of toys used on it.

Referring now to FIGS. 17*a* to 17*d*, an alternative embodiment of a support frame 312 for a playing structure module is shown. In this embodiment, the support frame includes four inter-engageable support frame elements 314 which are separable from one another to allow the support frame 312 to be dismantled. Of particular note is the fact that the support frame elements can be engaged to form the support frame 312 without the need for fasteners.

Each support frame element 312 includes a leg 316 and a horizontal cross bar 318 attached to one side of the leg near its upper surface 320. A generally U-shaped upstanding lip 322 is formed on the upper surface 320 of the leg 316 and is spaced from the marginal edges of the upper surface. The top part of the leg 316 is hollow and has a slot 324 formed in another of its sides. The cross bar 318 has a downwardly extending peg 330 at its distal end. Notches 332 are formed in the top of the cross bar 318 adjacent the peg 330 and the leg 316 to define retainer accommodating recesses. A notch 334 is also formed in the undersurface of the cross bar adjacent the peg 330.

When the support frame elements 314 are to be engaged, the pegs 330 of the support frame elements are inserted into the slots 324 formed in the legs 316 of other support frame elements to form the support frame 312. Once the support frame 312 has been formed, generally rectangular caps 340 having upstanding projections 342 on them are placed on the upper surfaces 320 to overlie the upstanding lips 332. The projections 342 correspond with complimentary formations formed on the re-orientatable tops to inhibit relative lateral movement between the support frames 312 and the re-orientatable tops.

Figure 18A:
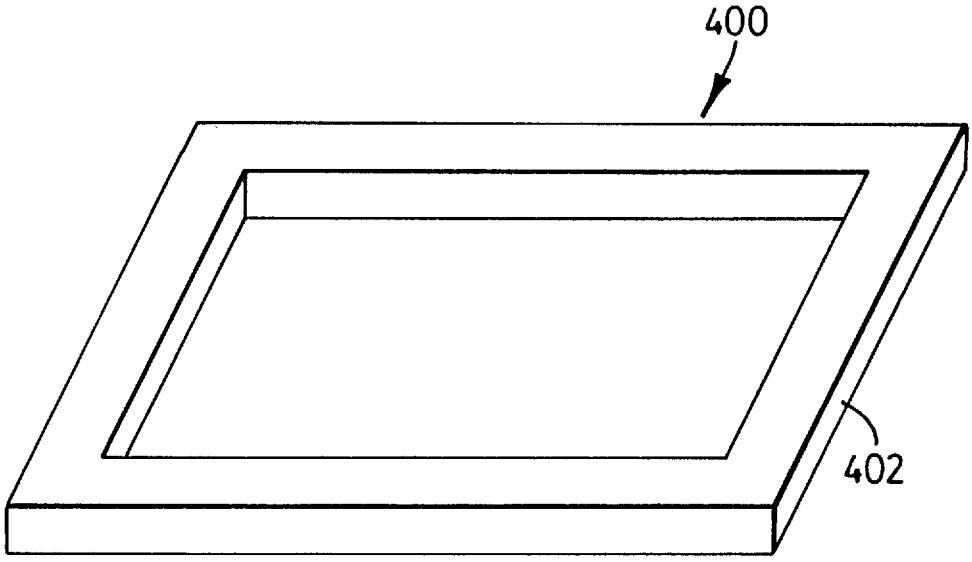
FIGS. 18*a*, 18*b* and 18*c* are perspective views of different embodiments of retainers for coupling abutting playing structure modules.

Referring now to FIG. 18*a*, a retainer 400 to couple a pair of adjacent playing structure modules having support frames of the type illustrated in FIGS. 17*a* to 17*d* to inhibit relative movement between the playing structure modules is shown. As can be seen, the retainer 400 is in the form of a generally rectangular ring formed of semi-rigid plastic material. The side walls 402 of the retainer are dimensioned to be approximately equal to the depth of the recesses 332.

Figure 18B:
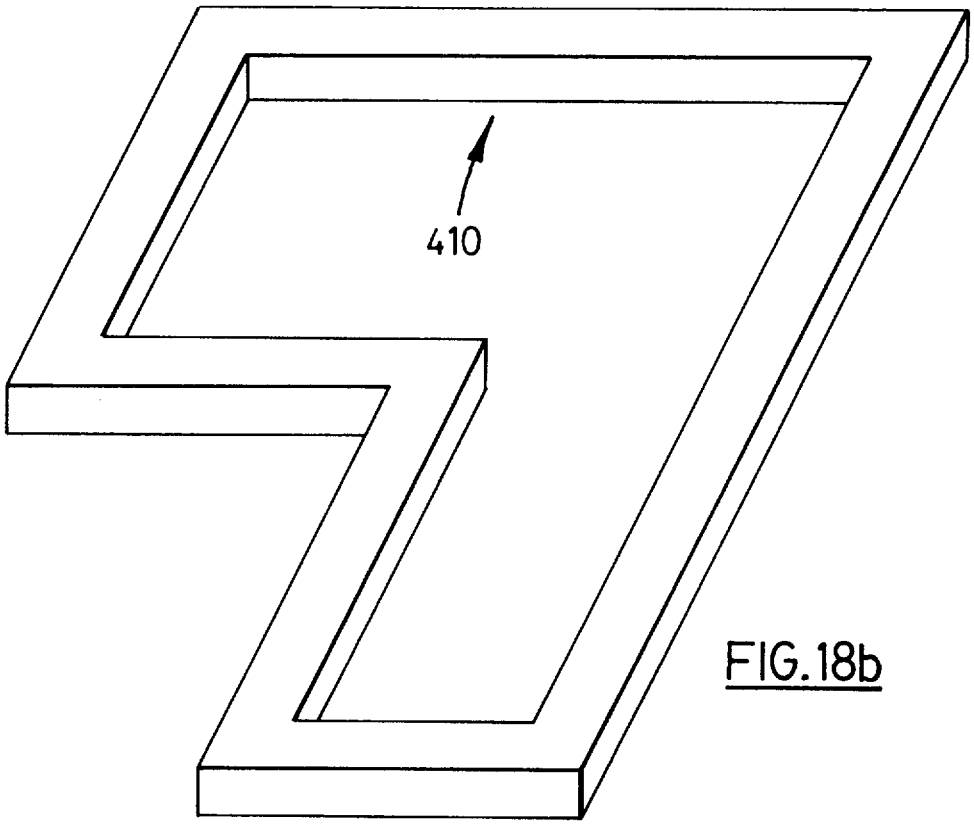
Figure 18C:
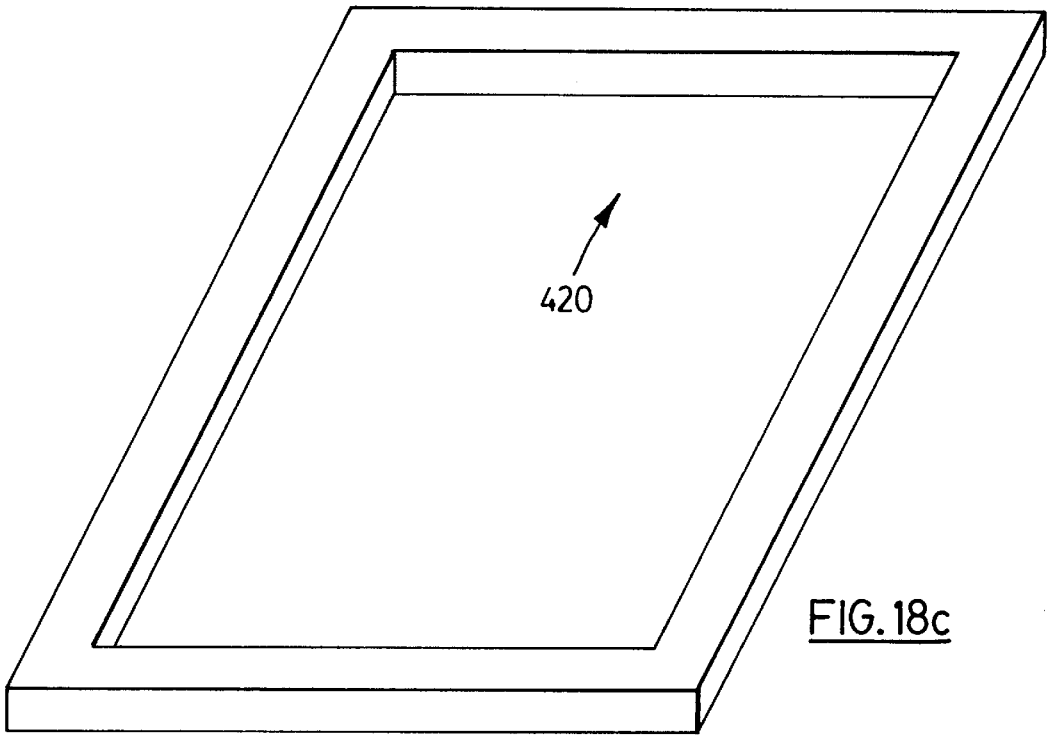

FIG. 18*b* shows a different embodiment of a retainer 410 designed to couple three playing structure modules arranged generally in an "L" formation. FIG. 18*c* shows yet another embodiment of a retainer 420 designed to couple four playing structure modules arranged to form a 2×2 array.

Figure 19:
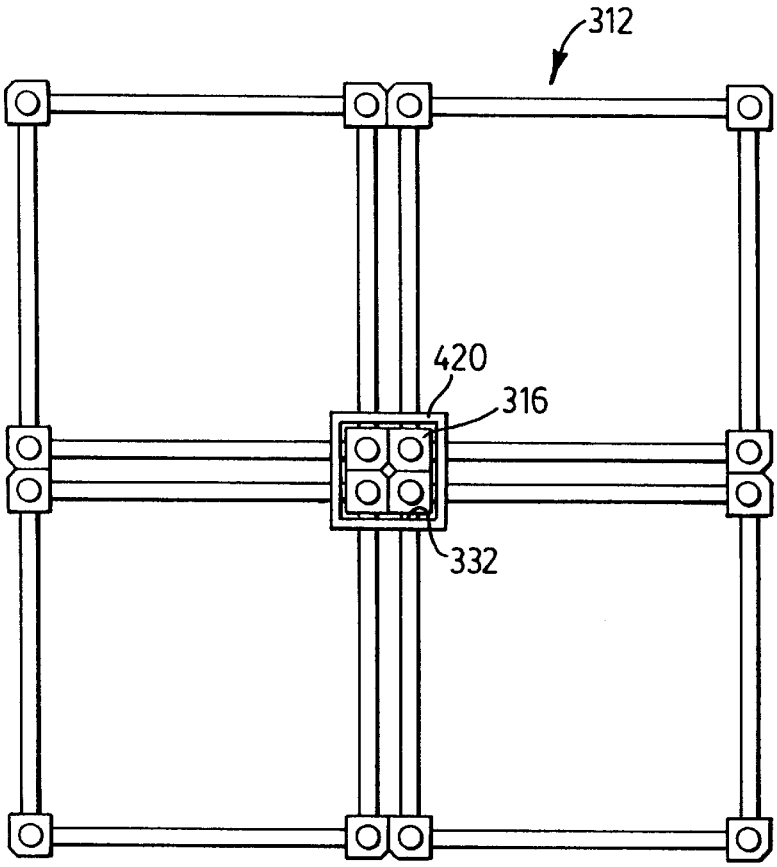
FIG. 19 is a top plan view of the an array of playing structure modules coupled by the retainer shown in FIG. 18*c;*

FIG. 19 shows retainer 420 in place coupling four playing structure modules arranged to form a playing structure. As can be seen, the retainer 420 rests in the recesses 332 formed in the four legs 316 of the playing structure modules that are centrally positioned in the playing structure and surrounds the four legs to inhibit relative movement of the playing structure modules. The dimensions of the retainer 420 and the recesses 332 ensure that the re-orientatable tops are properly seated when placed on the support frames 312.

Although the retainers 400, 410 and 420 have been described as being formed of semi-rigid plastic material, it should be realized that the retainers may also be formed of flexible resistant material such as rubber which may be stretched around the legs 316 and seated in the notches 332.

Figure 20A:
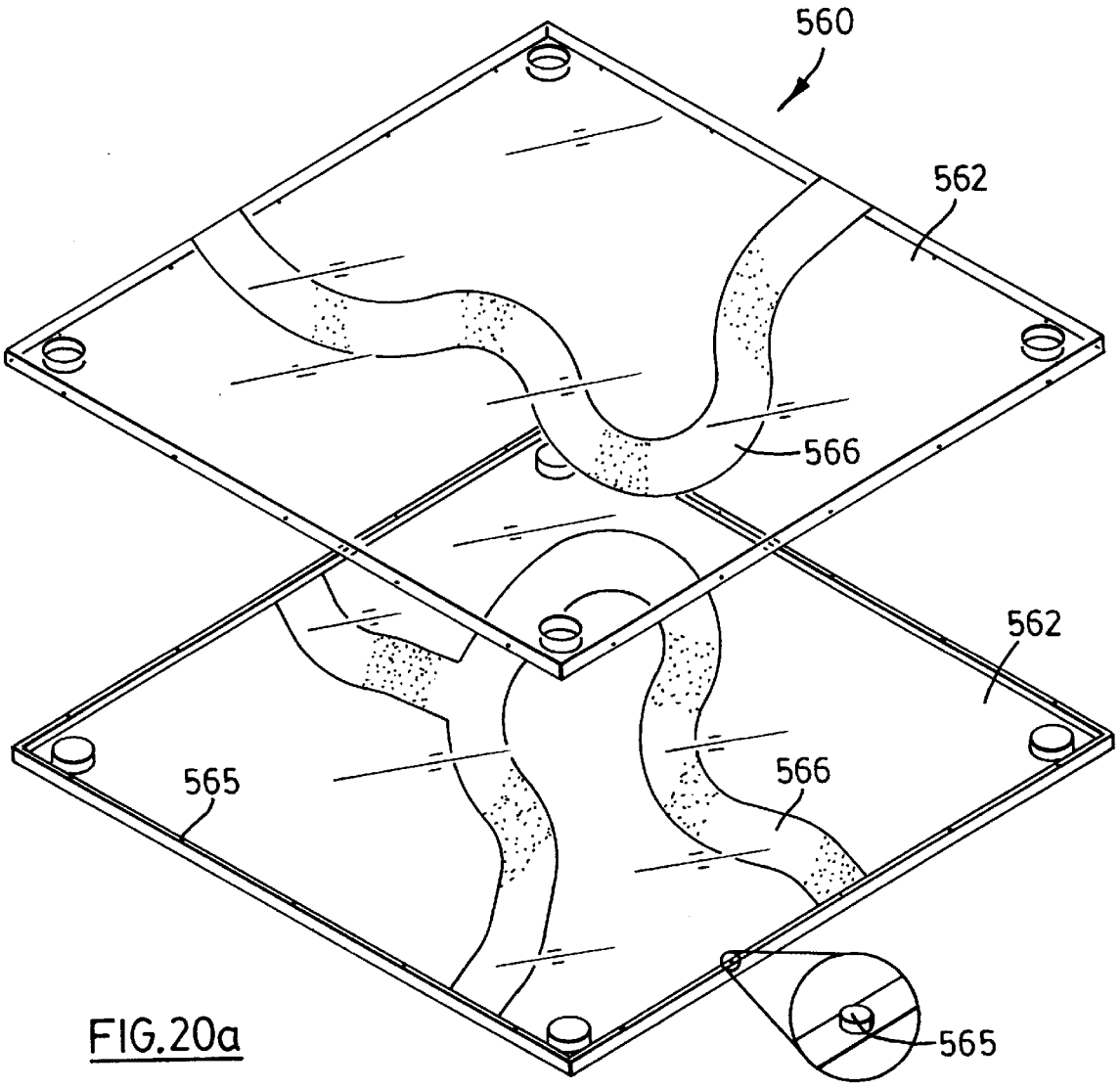
FIG. 20*a* is a perspective view respectfully of an alternative embodiment of a re-orientatable top for a playing structure module.
Figure 20B:
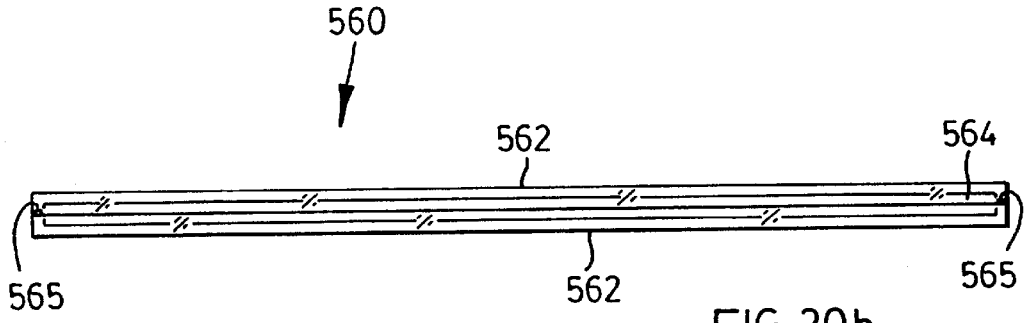
FIG. 20*b* is a sectional view of the re-orientatable top shown in FIG. 20*a*.

Referring now to FIGS. 20*a* and 20*b*, an alternative embodiment of a re-orientatable top 560 is shown. In this embodiment, the re-orientatable top 560 includes a pair of separable generally transparent elements 562 which are configured to define a space 564 within the interior of the top. The two elements 562 have mating configurations 565 so that the elements 562 snap fit together. A scene 566 is accommodated by space 564. In this case, the scene is drawn on the underside of each playing surface within space 564 which is visible through each element. Alternatively, a sheet having scenes thereon can be accommodated by the space 564 or decorations can be placed within the space 564. This allows the individual to colour and decorate the sheet as desired so that the individual can create their own scenes.

Although the re-orientatable top 560 has been described as having a pair of separable generally transparent elements, it should be apparent that only one of the elements 562 need be transparent. In this case, the opaque element will have a scene depicted on its outer playing surface while the scene associated with the generally transparent element can be created by an individual either by inserting a sheet having the desired scene thereon between the two elements, or by drawing the scene on one of the elements within the interior space 564.

I claim:

1. A playing structure comprising:

a plurality of playing structure modules arranged in an array, each of said playing structure modules including a re-orientatable top having at least two opposed major sides, each of said at least two major sides constituting a playing surface, the playing surface on each major side of said re-orientatable top depicting a different scene, each different scene including at least two contiguous scenic elements sharing at least one common boundary line running over said playing surface, said at least one boundary line having opposed ends extending to and being truncated by at least one side edge of said scene to define boundary line end points on said at least one side edge, said boundary line end points being unsymmetrical along said at least one side edge about a center point thereof; and a support supporting each said re-orientatable top above the surface on which said support is located in a manner such that one of said playing surfaces is upwardly presented, wherein the re-orientatable tops of said playing structure modules in said array are first arrangable such that an overall scene defined by the different scenes on the upwardly presented playing surfaces of adjacent playing structure modules is generally continuous and visually fluid, and such that the overall scene is generally continuous and visually fluid over the upwardly presented playing surfaces of adjacent playing structure modules when the re-orientatable top of the at least one playing structure module is re-orientated about a bisector extending across said re-orientatable top to present upwardly the other of the playing surfaces of the re-orientatable top.

2. A playing structure as defined in claim 1 wherein the re-orientatable top of each of said playing structure modules is generally rectangular in plan and wherein said bisector extends diagonally across said re-orientatable top or extends between the mid-points of opposed edges of said major sides.

3. A playing structure as defined in claim 2 wherein at least one of the playing surfaces on at least one re-orientatable top has a three-dimensional topography.

4. A playing structure as defined in claim 2 wherein said playing structure modules are formed in sets with each set depicting a unique setting.

5. A playing structure as defined in claim 4 where the different scenes on the re-orientatable tops of the playing structure modules in each set are configured to permit other sets of playing structure modules to be arranged in larger arrays while still presenting a generally continuous, visually fluid overall scene.

6. A playing structure as defined in claim 2 wherein said playing structure modules are arrangable to create arrays of varying configurations.

7. A playing structure module as defined in claim 2 wherein the support of each playing structure is in the form of a frame having an open interior, at least one of said frames supporting a secondary playing surface below said re-orientatable top.

8. A playing structure as defined in claim 7 wherein said secondary surface has a three dimensional topography to constitute a secondary playing surface.

9. A playing structure as defined in claim 8 wherein said playing structure modules are stackable to create three-dimensional arrays and wherein the frames of playing structure modules placed on top of other playing structure modules are configured to provide access to the re-orientatable tops of the playing structure modules below them.

10. A playing structure as defined in claim 9 further including side walls on selected sides of at least some of said frames, said side walls presenting a surface with graphics thereon consistent with said secondary playing surface.

11. A playing structure as defined in claim 3 wherein said three-dimensional topography includes at least one formation on a portion of said playing surface and spaced from the side edges thereof, said at least one formation having a stepped profile so that said three dimensional topography provides generally planar, horizontal surfaces at at least two different elevations, said planar surfaces constituting support platforms for toys.

12. A playing structure as defined in claim 2 further including retaining means acting between said re-orientatable tops and said supports to inhibit relative lateral movement therebetween.

13. A playing structure as defined in claim 12 wherein said retaining means are in the form of complimentary formations on said re-orientatable tops and said supports.

14. A playing structure as defined in claim 8 wherein at least one re-orientatable top has at least one passage therethrough to permit access to said secondary playing surface.

15. A playing structure as defined in claim 2 wherein the different scene on each of said playing surfaces has less than four-fold symmetry.

16. A playing structure as defined in claim 15 wherein the different scene on each of said playing surfaces has two-fold symmetry.

17. A playing structure as defined in claim 1 further including retaining means acting between adjacent playing structure modules in said array to inhibit relative movement therebetween.

18. A playing structure as defined in claim 17 wherein said retaining means is in the form of at least one removable retainer to couple the supports of adjacent playing structure modules.

19. A playing structure comprising:

a playing structure module including a re-orientatable top constituted by a plurality of re-orientatable top elements, said top elements having playing surfaces on opposed major sides thereof, the playing surfaces on said major sides depicting different scenes, each of said different scenes including at least two contiguous scenic elements sharing at least one common boundary line running over said playing surface, said at least one boundary line having opposed ends extending to and being truncated by at least one side edge of said different scene to define boundary line end points on said at least one side edge, said boundary line end points being unsymmetrical along said at least one side edge about a center point thereof; and a support frame for supporting said re-orientatable top above the surface on which said support frame is located in a manner such that one of said playing surfaces of each top element is upwardly presented, wherein the re-orientatable top elements are first arrangeable such that an overall scene defined by the different scenes on the upwardly presented playing surfaces of the re-orientatable top elements is generally continuous and visually fluid, and such that the overall scene is generally continuous and visually fluid over the upwardly presented playing surfaces of the re-orientatable top elements when that re-orientatable top element is re-orientated about a bisector extending across said at least one re-orientatable top element to present upwardly the other of the playing surfaces of that re-orientatable top.

20. A playing structure as defined in claim 19 further including retaining means acting between the support and said re-orientatable top elements.

* * * * *